US005213245A

United States Patent [19]

Puaatuua

[11] Patent Number: 5,213,245

[45] Date of Patent: May 25, 1993

[54] CLEAR-WRAP DISPENSER

[76] Inventor: Tupua M. Puaatuua, 3200 Wailea Alanui Dr. #1501, Wailea, Hi. 96753-7740

[21] Appl. No.: 962,697

[22] Filed: Oct. 19, 1992

[51] Int. Cl.[5] ..... B65D 85/671; B26F 3/02

[52] U.S. Cl. ..... 225/19; 225/39; 225/89

[58] Field of Search ..... 83/649, 650; 225/89, 225/19, 39, 20, 91; 156/579

[56] References Cited

U.S. PATENT DOCUMENTS

| | | | |
|---|---|---|---|
| 427,246 | 5/1890 | Wilson | 225/89 X |
| 450,168 | 4/1891 | Loft | 225/89 X |
| 2,826,374 | 3/1958 | Kresser | 225/89 |
| 3,034,690 | 5/1962 | Klun | 225/19 |
| 4,417,495 | 11/1983 | Gordon et al. | 83/649 X |
| 4,787,284 | 11/1988 | Chen | 83/649 X |
| 4,951,858 | 8/1990 | Krall | 225/19 |

*Primary Examiner*—Frank T. Yost

*Assistant Examiner*—Rinaldi Rada

*Attorney, Agent, or Firm*—Michael I. Kroll

[57] ABSTRACT

An improved clear-wrap dispenser is provided which consists of a housing having a bottom wall, a front wall and a pair of side walls, so as to form a compartment therein with an open back and an open top. A generally U-shaped handle is pivotally mounted to the side walls of the housing, so that when in an upright position the handle can be gripped to carry the housing. A roll of clear-wrap is rotatably positioned within the compartment in the housing from the open back between the side walls, so as to be dispensed therefrom through the open top. A cutting blade is disposed within the housing along a top edge of the front wall. A mechanism is for retracting and extracting the cutting blade with respect to the top edge of the front wall of the housing by pivoting the handle on the side walls, so that when retracted the cutting blade will be safely stored and when extracted the cutting blade will be able to cut the clear-wrap being dispensed therefrom.

15 Claims, 3 Drawing Sheets

CLEAR-WRAP DISPENSER

BACKGROUND OF THE INVENTION

1. Field of the Invention

The instant invention relates generally to dispensers and more specifically it relates to an improved clear-wrap dispenser.

2. Description of the Prior Art

Numerous dispensers have been provided in prior art that are machines or containers that allow their contents to be taken out and used in convenient or in prescribed amount. While these units may be suitable for the particular purpose to which they address, they would not be as suitable for the purposes of the present invention as heretofore described.

SUMMARY OF THE INVENTION

A primary object of the present invention is to provide an improved clear-wrap dispenser that will overcome the shortcomings of the prior art devices.

Another object is to provide an improved clear-wrap dispenser that has a handle for easy carrying and lifting, while the cutting blade is retractable into the housing of the dispenser during times of storage and non-use.

An additional object is to provide an improved clear-wrap dispenser in which the handle pivotable on the housing will cause the extraction and retraction of the cutting blade, so as to cut down on injuries associated with the cutting blade during the times of storage and non-use.

A further object is to provide an improved clear-wrap dispenser that is simple and easy to use.

A still further object is to provide an improved clear-wrap dispenser that is economical in cost to manufacture.

Further objects of the invention will appear as the description proceeds.

To the accomplishing of the above and related objects, this invention may be embodied in the form illustrated in the accompanying drawings, attention being called to the fact, however, that the drawings are illustrative only, and that changes may be made in the specific construction illustrated an described within the scope of the appended claims.

BRIEF DESCRIPTION OF THE DRAWING FIGURES

DETAILED DESCRIPTION OF THE PREFERRED EMBODIMENTS

Figure 1:
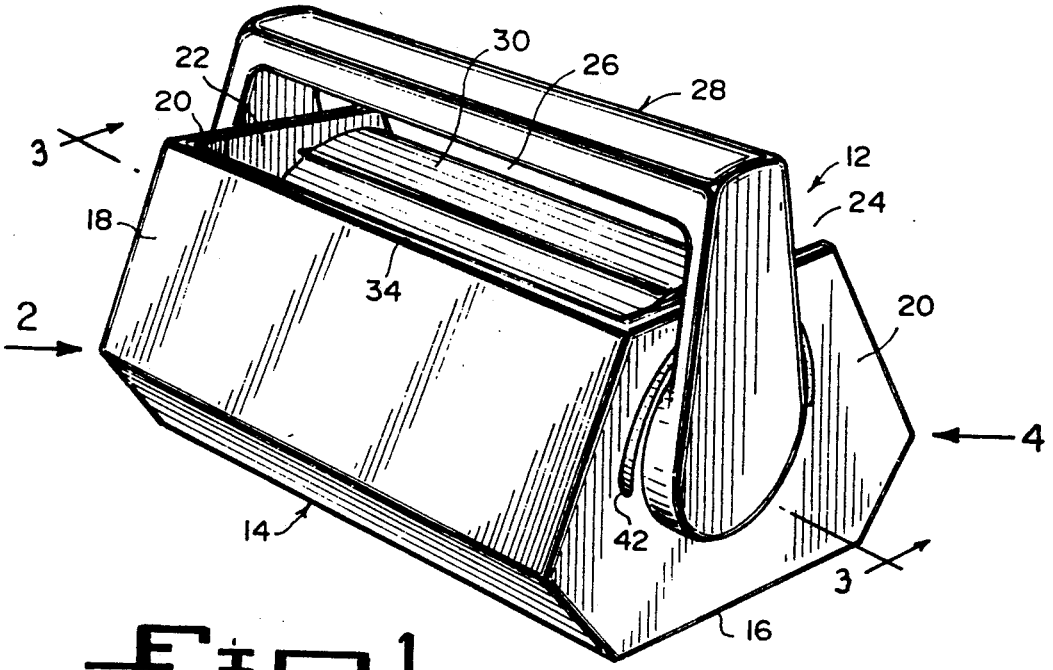
FIG. 1 is a front perspective view of the instant invention with the handle in the carrying position.
Figure 2:
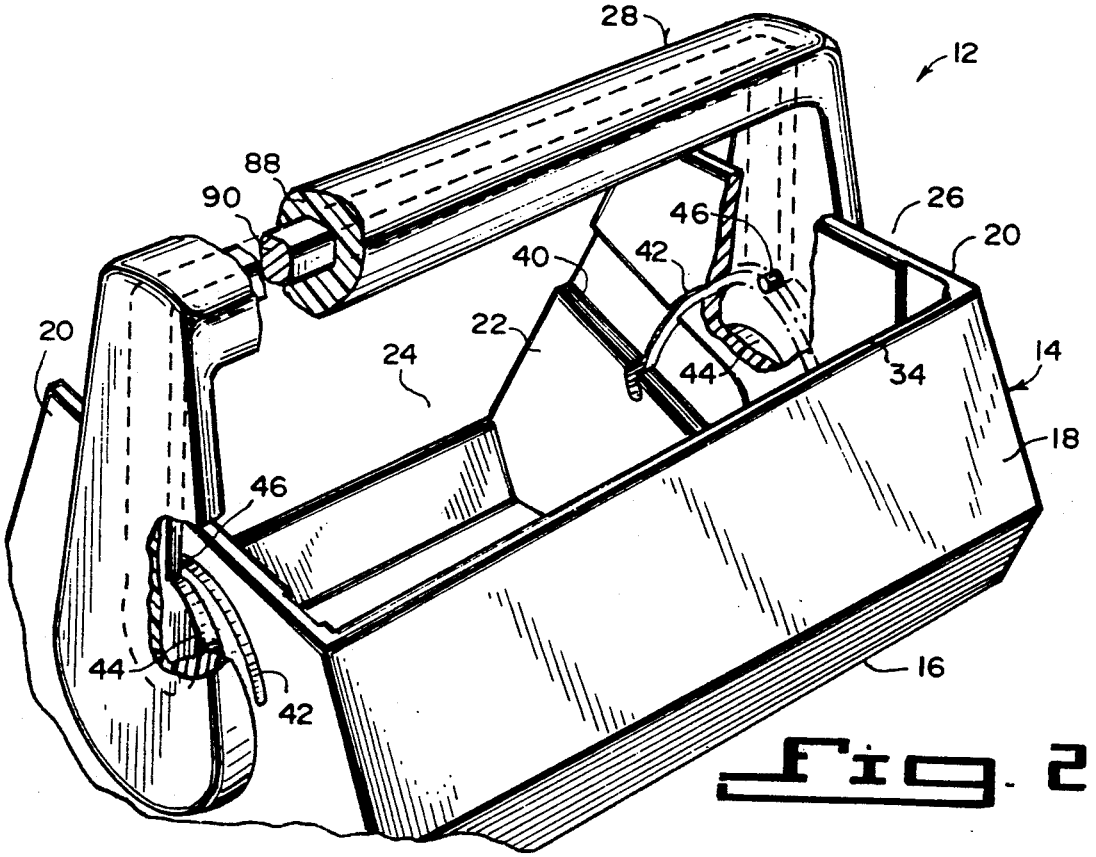
FIG. 2 is a front perspective view taken in the direction of arrow 2 in FIG. 1, with parts broken away.
Figure 3:
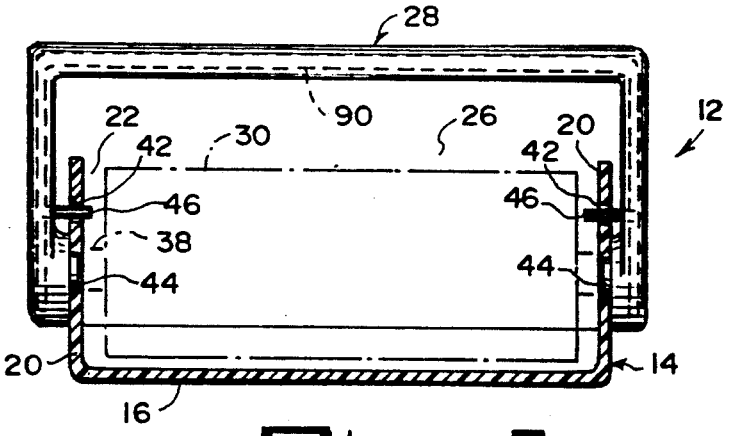
FIG. 3 is a cross sectional view taken along line 3—3 in FIG. 1.
Figure 4:
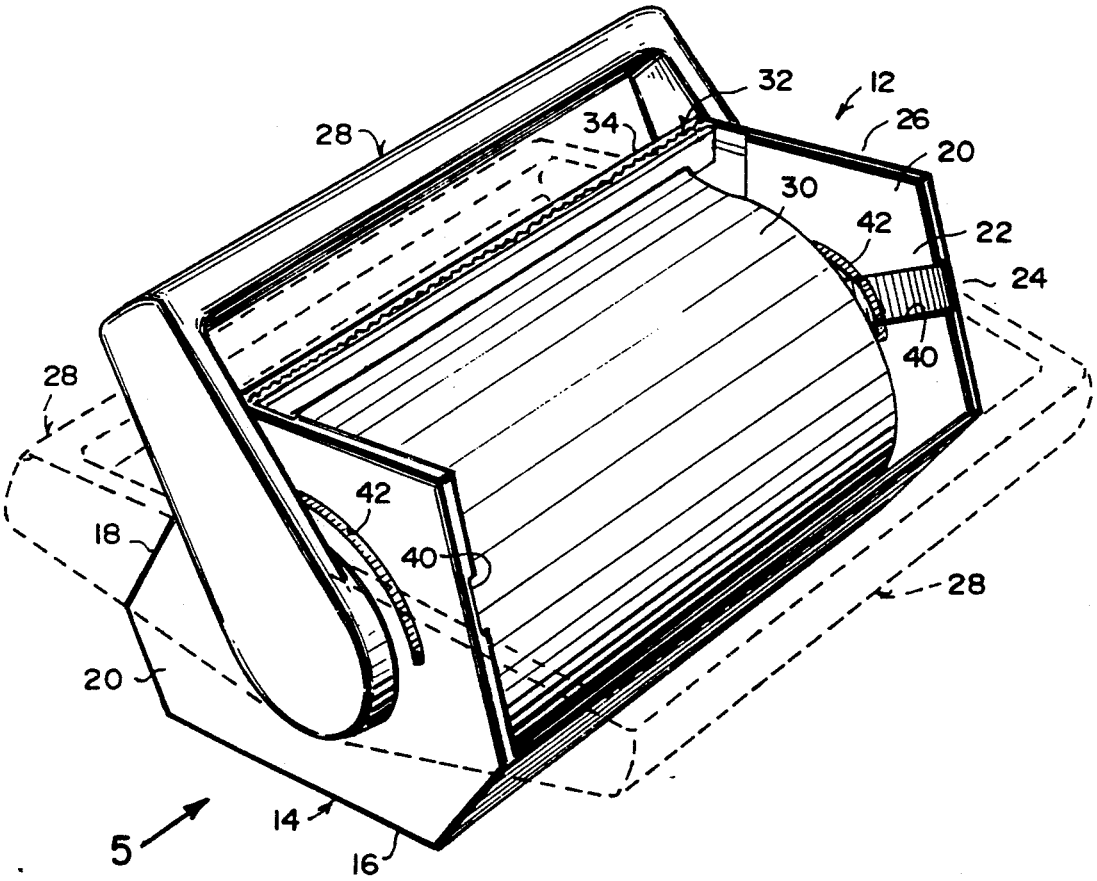
FIG. 4 is a rear perspective view taken in the direction of arrow 4 in FIG. 1, with the handle going into the front resting position.
Figure 5:
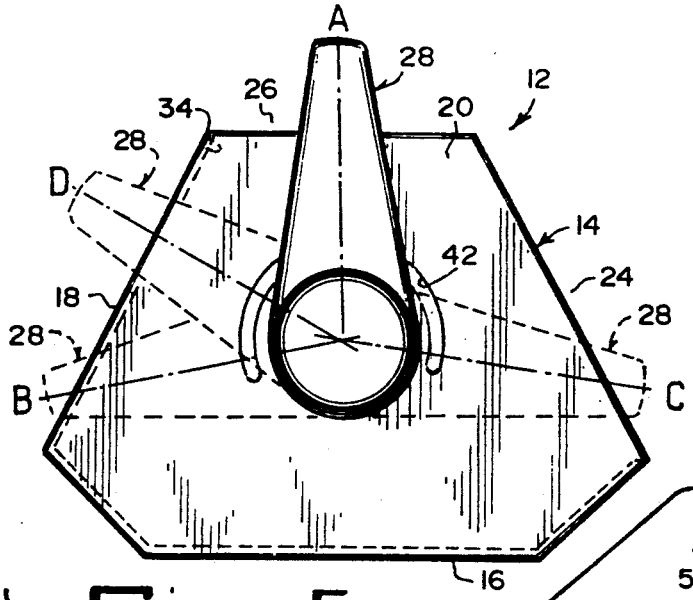
FIG. 5 is a side elevational view taken in the direction of arrow 5 in FIG. 4, showing the various positions for the handle.
Figure 6:
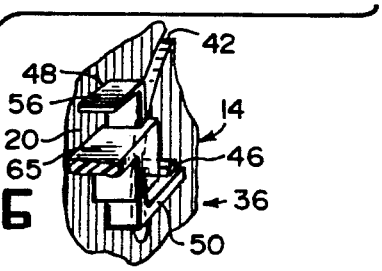
FIG. 6 is a perspective view of a portion of the retracting/extracting mechanism for the cutting blade within the housing.
Figure 7:
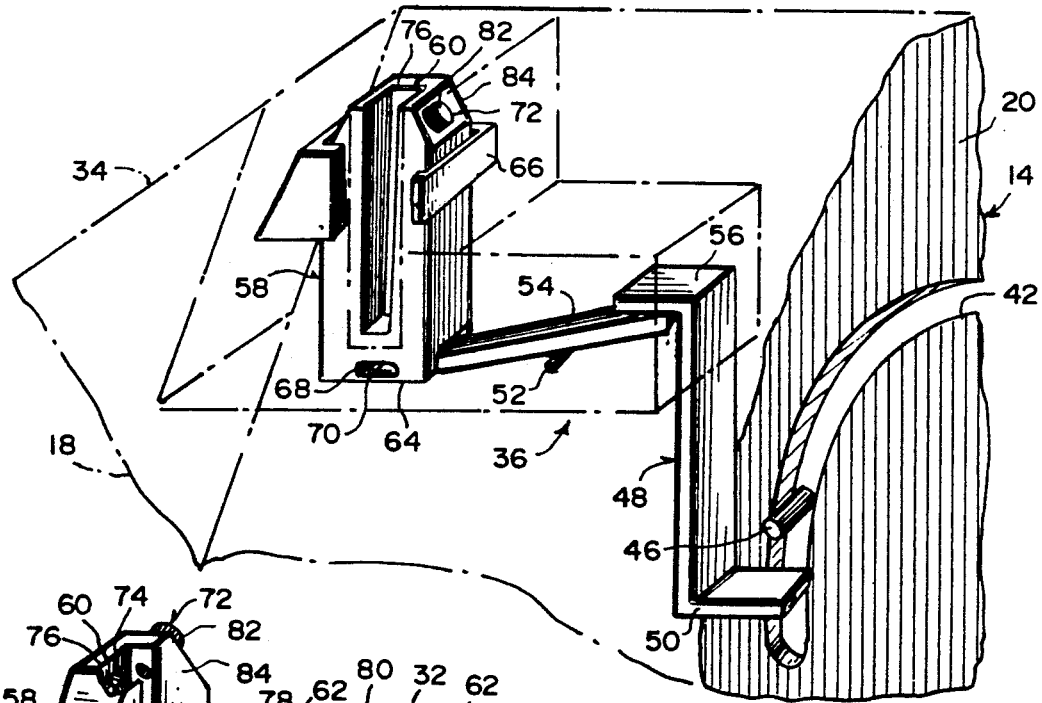
FIG. 7 is a perspective view of still more of a portion of the retracting/extracting mechanism for the cutting blade within the housing.
Figure 8:
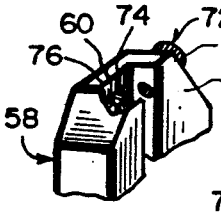
FIG. 8 is a perspective view of a top portion of on of the blade brackets showing the retaining structures for the plastic and steel cutting blades.
Figure 9:
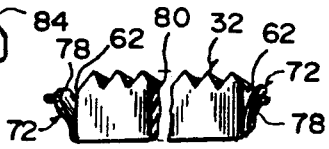
FIG. 9 is a perspective view with parts broken away of the plastic cutting blade showing the locking clips on both ends thereof.
Figure 10:
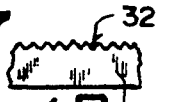
FIG. 10 is an elevational view of a portion of the steel cutting blade.

Turning now descriptively to the drawings, in which similar reference characters denote similar elements throughout the several views, the Figures illustrate an improved clear-wrap dispenser 12 which consists of a housing 14 having a bottom wall 16, a front wall 18 and a pair of side walls 20, so as to form a compartment 22 therein with an open back 24 and an open top 26.

A generally U-shaped handle 28 is pivotally mounted to the side walls 20 of the housing 14. When in an upright position, the handle 28 can be gripped to carry the housing 14. A roll of clear-wrap 30 is rotatably positioned within the compartment 22 in the housing from the open back 24 between the side walls 20, so as to be dispensed therefrom through the open top 26. A cutting blade 32 is disposed within the housing 14 along a top edge 34 of the front wall 18. A mechanism 36 is for retracting and extracting the cutting blade 32 with respect to the to edge 34 of the front wall 18 of the housing 14, by pivoting the handle 28 on the side walls 20. When retracted the cutting blade 32 will be safely stored and when extracted the cutting blade 32 will be able to cut the clear-wrap 30 being dispensed therefrom.

A roller shaft 38 is for the roll of clear wrap 30 to rotate upon. Each side wall 20 of the housing 14 has an inwardly tilted track 40 extending from the pen back 24, so as to guide the roller shaft 38 thereon for rotation of the roll of clear wrap 30.

The retracting and extracting mechanism 36 includes each side wall 20 the housing 14 having a semi-circular track 42 formed therein. The handle 28 has a pair of boss portions 44, each to ride within one side wall 20 of the housing 14 in the center of the semi-circular track 42. A pair of catch pins 46 are provided with each extending from the handle 28 to ride within each of the semi-circular tracks 42.

A pair of Z-shaped sliding arms 48 are each vertically carried within each side wall 20 of the housing 14 in a slideable condition. Each catch pin 46 can engage with a lower leg 50 of each sliding arm 48 for movement downwardly. A pair of support pins 52 are each carried within each side wall 20 of the housing 14. A pair of rocker arms 54 are mounted within the housing 14, so that each rocker arm 54 will be carried on one of the support pins 52, with a first side of the rocker arm to engage with an upper leg 56 of each sliding arm 48. A pair of blade brackets 58 are provided with each having a vertical side slot 60 to receive one end 62 of the cutting blade 32, with its bottom end 64 pivotally connected to a second side of the rocker arm 54.

A pair of sliding arm brackets 65, are each mounted to the side wall 20 within the compartment 22 of the housing 14, so as to guide each sliding arm 48 therein.

A pair of blade bracket tracks 66 are each mounted to one of the side walls 20 within the compartment 22 of the housing 14, so as to guide each blade bracket 58 therein. Each blade bracket 58 has a horizontal slot 68 located below the vertical side slot 60. Each rocker arm 54 has a transverse swivel pin 70 located in the second side of the rocker arm 54, to ride within the horizontal slot 68 in the blade bracket 58.

A structure 72 is for releasably retaining the cutting blade 32 within the vertical side slots of the blade brackets 58, so that the cutting blade 32 can be removed and replaced when needed. The releasably retaining structure 72 includes each blade bracket 58 having a aperture 74 located within an upper back portion 76 of the vertical side slot 60. The cutting blade 32 has a pair of locking clips 78 located on each end 62 thereof, so as to each engage with the aperture 74 within each blade bracket 58.

The cutting blade 32 is fabricated out of plastic material 80. The releasably retaining structure 72 can also include a pair of set screws 82, each threaded within an upper side portion 84 of each blade bracket 58, so as to engage with the cutting blade 32. The cutting blade 32 in the instance can be fabricated out of steel 86.

The handle 28 is fabricated out of plastic material 88 and further contains a metal reinforcement bar 90 therein for added strength.

LIST OF REFERENCE NUMBERS 12 improved clear-wrap dispenser
14 housing
16 bottom wall of 14
18 front wall of 14
20 side wall of 14
22 compartment in 14
24 open back of 14
26 open top of 14
28 U-shaped handle
30 roll of clear wrap
32 cutting blade
34 top edge of 18
36 retracting and extracting mechanism
38 roller shaft for 30
40 inwardly tilted track on 20 for 38
42 semi-circular track in 20
44 boss portion on 28
46 catch pin
48 Z-shaped sliding arm
50 lower leg of 48
52 support pin
54 rocker arm
56 upper leg of 48
58 blade bracket
60 vertical side slot in 58
62 end of 32
64 bottom end of 58
65 sliding arm bracket
66 blade bracket track
68 horizontal slot in 58
70 swivel pin on 54
72 releasably retaining structure
74 aperture in 58
76 upper back portion of 60
78 locking clip on 62 of 32
80 plastic material for 32
82 set screw
84 upper side portion of 58
86 steel for 32
88 plastic material for 28
90 metal reinforcement bar in 28

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved clear-wrap dispenser which comprises:
   a) a housing having a bottom wall, a front wall and a pair of side walls, so as to form a compartment therein with an open back and an open top;
   b) a generally U-shaped handle pivotally mounted to said side walls of said housing, so that when in an upright position said handle can be gripped to carry said housing;
   c) a roll of clear-wrap rotatably positioned within said compartment in said housing from said open back between said side walls, so as to be dispensed therefrom through said open top;
   d) a cutting blade disposed within said housing along a top edge of said front wall; and
   e) means for retracting and extracting said cutting blade with respect to the top edge of said front wall of said housing by pivoting said handle on said side walls, so that when retracted said cutting blade will be safely stored and when extracted said cutting blade will be able to cut said clear-wrap being dispensed therefrom.

2. An improved clear-wrap dispenser as recited in claim 1, further including roller shaft for said roll of clear-wrap to rotate upon.

3. An improved clear-wrap dispenser as recited in claim 2, wherein each said side wall of said housing having an inwardly tilted track extending from the open back, so as to guide said roller shaft thereon for rotation of said roll of clear-wrap.

4. An improved clear-wrap dispenser as recited in claim 3, wherein said retracting and extracting means includes:
   a) each said side wall of said housing having a semi-circular track formed therein;
   b) said handle having a pair of boss portions, each to ride within one side wall of said housing in the center of said semi-circular track; and
   c) a pair of catch pins, each extending from said handle to ride within each of said semi-circular tracks.

5. An improved clear-wrap dispenser as recited in claim 4, wherein said retracting and extracting means further includes:
   a) a pair of Z-shaped sliding arms, each vertically carried within each said side wall of said housing in a slideable condition, so that each said catch pin can engage with a lower leg of each said sliding arm for movement downwardly;

b) a pair of support pins, each carried within each said side wall of said housing;

c) a pair of rocker arms mounted within said housing, so that each said rocker arm will be carried on one of said support pins with a first side of said rocker arm to engage with an upper leg of each said sliding arm; and d) a pair of blade brackets, each having a vertical side slot to receive one end of said cutting blade, with its bottom end pivotally connected to a second side of said rocker arm.

6. An improved clear-wrap dispenser as recited in claim 5, wherein said retracting and extracting means further includes a pair of sliding arm brackets, each mounted to said side wall within said compartment of said housing, so as to guide each said sliding arm therein.

7. An improved clear-wrap dispenser as recited in claim 6, wherein said retracting and extracting means further includes a pair of blade bracket tracks, each mounted to said side wall within said compartment of said housing, so as to guide each said blade bracket therein.

8. An improved clear-wrap dispenser as recited in claim 7, wherein said retracting and extracting means further includes:

a) each said blade bracket having a horizontal slot located below said vertical side slot; and b) each said rocker arm having a transverse swivel pin located in said second side of said rocker arm to ride within said horizontal slot in said blade bracket.

9. An improved clear-wrap dispenser as recited in claim 8, further including means for releasably retaining said cutting blade within said vertical side slots of said blade brackets, so that said cutting blade can be removed and replaced when needed.

10. An improved clear-wrap dispenser as recited in claim 9, wherein said releasably retaining means includes:

a) each said blade bracket having an aperture located within an upper back portion of said vertical side slot; and b) said cutting blade having a pair of locking clips located on each end thereof, so as to each engage with said aperture within each said blade bracket.

11. An improved clear-wrap dispenser as recited in claim 10, wherein said cutting blade is fabricated out of plastic material.

12. An improved clear-wrap dispenser as recited in claim 9, wherein said releasably retaining means includes a pair of set screws, each threaded within an upper side portion of each blade bracket, so as to engage with said cutting blade.

13. An improved clear-wrap dispenser as recited in claim 12, wherein said cutting blade is fabricated out of steel.

14. An improved clear-wrap dispenser as recited in claim 9, wherein said handle is fabricated out of plastic material.

15. An improved clear-wrap dispenser as recited in claim 14, wherein said handle further includes a metal reinforcement bar therein for added strength.

* * * * *